United States Patent [19]

Fujita

[11] Patent Number: 5,072,807

[45] Date of Patent: Dec. 17, 1991

[54] MOVING STAIRCASE ESCAPE-WAY FROM OFFSHORE PLATFORMS

[75] Inventor: Tokume Fujita, Rio de Janeiro, Brazil

[73] Assignee: Petroleo Brasileiro S.A.-Petrobras, Rio De Janeiro, Brazil

[21] Appl. No.: 534,057

[22] Filed: Jun. 6, 1990

[30] Foreign Application Priority Data

Jun. 20, 1989 [BR] Brazil ..... 8902977

[51] Int. Cl.[5] ..... E06C 9/14

[52] U.S. Cl. ..... 182/42; 182/196

[58] Field of Search ..... 182/42–44, 182/196

[56] References Cited

U.S. PATENT DOCUMENTS

| | | | |
|---|---|---|---|
| 255,379 | 3/1882 | Darby | 182/42 |
| 290,961 | 12/1883 | Bixby | 182/43 |
| 299,511 | 6/1884 | Blessing | 182/42 |
| 306,489 | 10/1884 | Hubbard | 182/43 |
| 331,081 | 11/1885 | Neumeyer | 182/42 |
| 486,493 | 11/1892 | McCollom | 182/43 |
| 637,878 | 11/1899 | Lepore | 182/42 |
| 1,191,504 | 7/1916 | Gray | 182/42 |
| 2,963,178 | 12/1960 | Walker | 182/43 |

*Primary Examiner*—Reinaldo P. Machado

*Attorney, Agent, or Firm*—Sughrue, Mion, Zinn, Macpeak & Seas

[57] ABSTRACT

A moving staircase escape-way from offshore platforms, which consists of two pairs of parallel wire ropes that pass through the ends of a plurality of rolls spaced equally apart. Selected rolls, belonging to the first pair of steel ropes lying substantially parallel to rolls belonging to the second pair of wire ropes, are connected to one another by pairs of non-skid rungs, spaced equally apart. The space between the pairs of rungs being about the same as the average height of a man. The moving staircase is fitted onto pulleys on the edge of a cylindrical drum, shafts of which fit into a support on the offshore platform.

4 Claims, 3 Drawing Sheets

MOVING STAIRCASE ESCAPE-WAY FROM OFFSHORE PLATFORMS

FIELD OF THE INVENTION

This invention deals with a moving staircase escape-way for offshore platforms meant to enable such platforms to be evacuated in practical, methodical and safe fashion.

BACKGROUND OF THE INVENTION

One of the ways of abandoning offshore platforms as required under building regulations so far followed is by means of a rope ladder with wooden rungs, known as a Jacobs or hanging ladder, wound over a reel at a point on the escape-way and intended to be tossed overboard in cases of emergency. It is a difficult ladder to use, especially if only one man climbs down it, or if he is the first to do so, because the bottom end of the latter hangs loose, causing its rungs to shift inwards when stepped upon, which makes the man climbing down it have to hang on practically by his hands. Therefore, when there is an emergency and people panic, many accidents are likely to happen.

SUMMARY OF THE INVENTION

To overcome the above-noted difficulties this invention provides an endless moving staircase as an escape-way from offshore platforms, so that in escaping therefrom the ladder takes the man down rather than the man climbing down the ladder. Such moving staircase consists of two pairs of wire ropes, preferably of stainless steel, parallel to one another, that pass through a plurality of rolls lying equally apart from each other, rolls from the first pair of endless steel ropes to lie substantially parallel to the next ones belonging to the second pair of endless steel ropes. Selected pairs of rolls from the first pair of ropes are joined to corresponding pairs of rolls on the second pair of ropes by pairs of non-skid rungs likewise equally spaced apart. The spaces between said pairs of rungs are about the average height of a man. The moving staircase being fastened onto pulleys at the sides of the stair, which pulleys lie on a cylindrical drum. Shafts stick out of the drum beyond the pulleys and fit into holes in triangular pieces mounted on rectangular rests attached to the offshore platform.

DESCRIPTION OF THE PREFERRED EMBODIMENT

Figure 1:
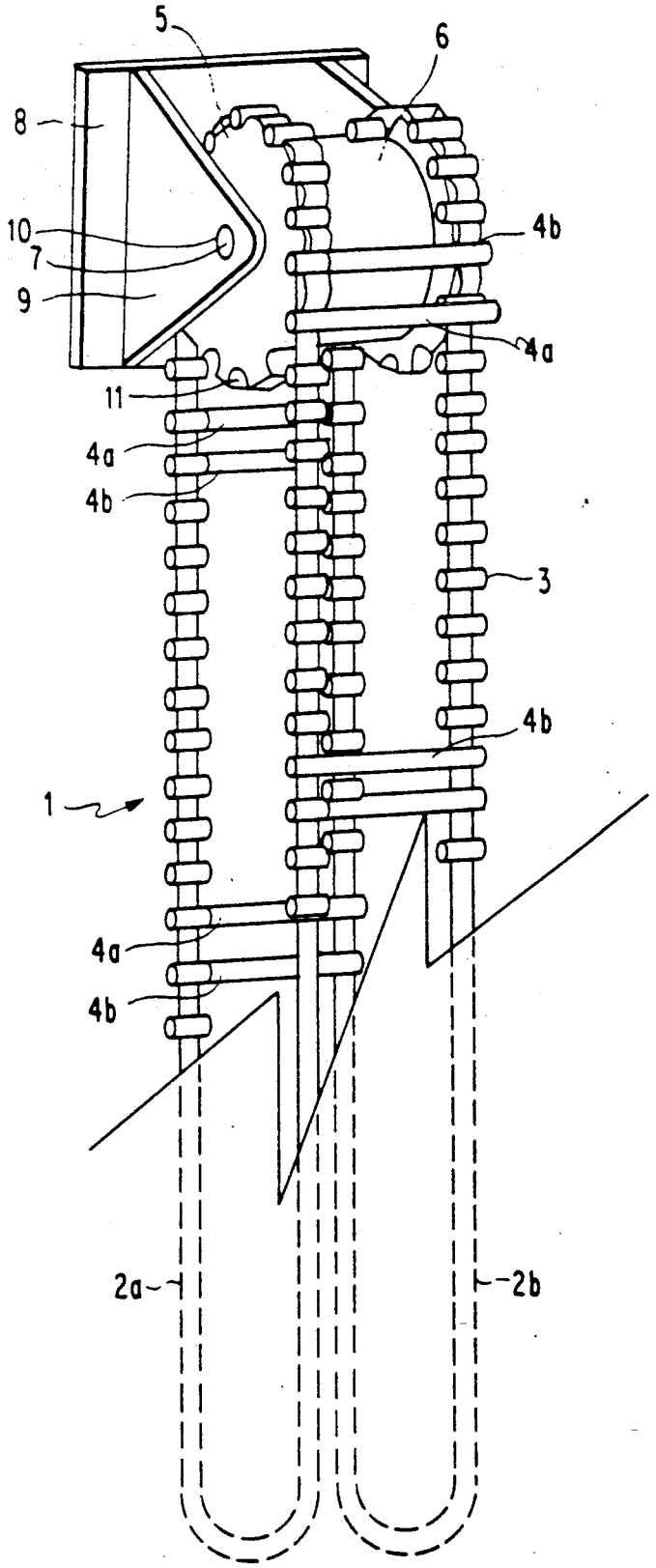
FIG. 1 is a view in perspective of the moving staircase covered by the invention.
Figure 2:
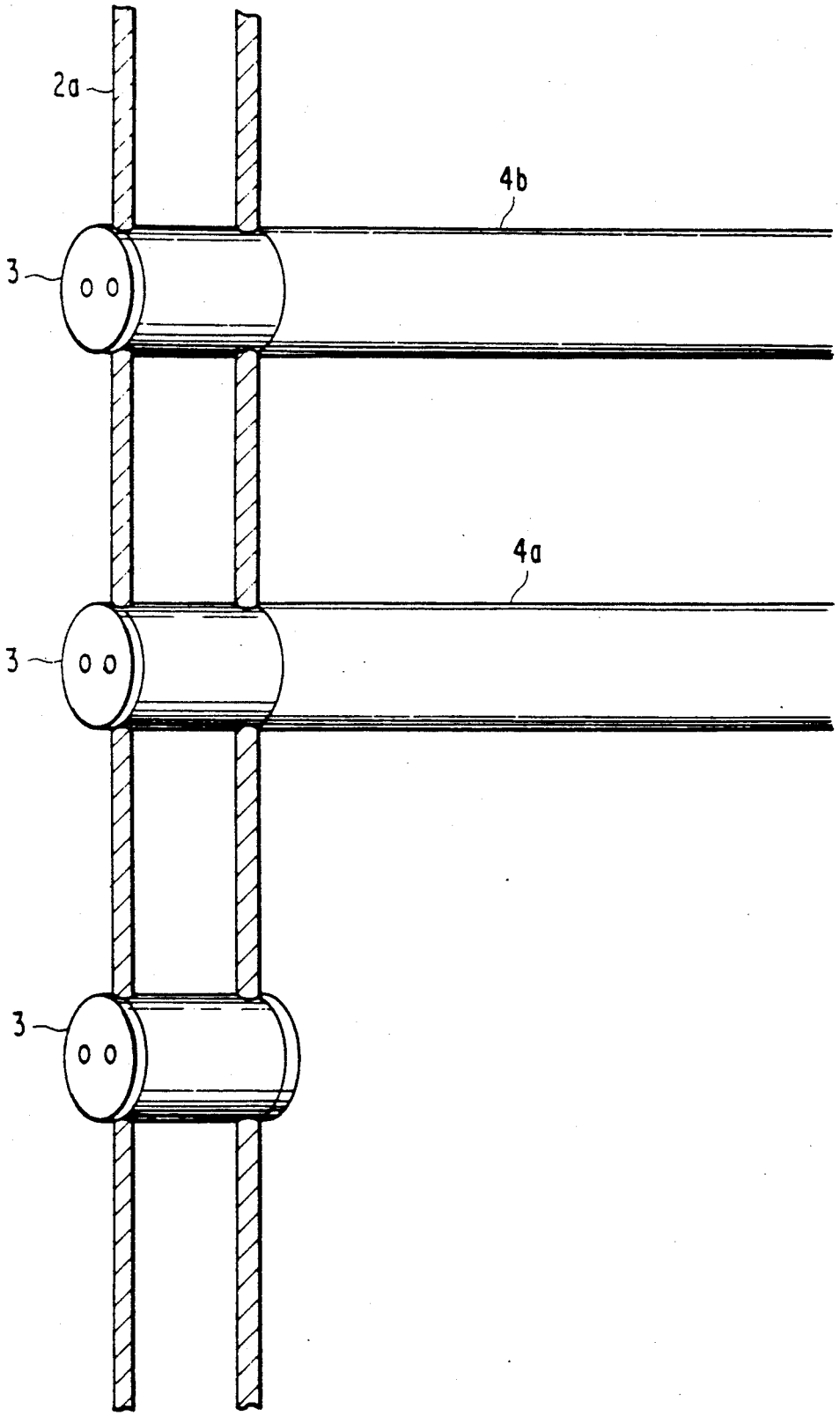
FIG. 2 is an enlarged front view of part of staircase removed from its pulleys.

As can be deduced from the attached figures, the moving staircase escape-way for offshore platforms of this invention, as generally shown by reference number (1), consists of two pairs of steel ropes (2*a*, 2*b*), preferably of stainless steel, parallel to one another and which run through both ends of a plurality of rolls (3) spaced equally apart. The rolls (3) belonging to the first pair of endless steel ropes (2) lying substantially parallel to the rolls (3) next to them, belonging to the second pair of endless steel ropes (2*b*), are connected to each other by means of pairs of non-skid rungs (4*a*, 4*b*), (see FIG. 2). The spaces between the pairs of rungs (4*a*, 4*b*) are about that of the average height of a man (see FIG. 1). The moving staircase (1) is fitted by means of pulleys on to the edge of a cylindrical drum (6). Shafts (7) stick out beyond the pulleys (5) and fit into holes (10) in triangular pieces (9). The cylindrical drum (6) is provided with a dynamic brake inside it (either mechanical or magnetic) of the usual kind, regulated for maximum speed, thereby enabling the staircase to move over a certain distance in a given time, and thus enabling the offshore platform to be swiftly evacuated. The pulleys (5) are provided with semi-circular slots (11) set equally apart, the rolls (3) lying apart in such a way as to exactly fit into the semi-circular slots (11), which lie the same distance apart, as the staircase (1) moves around.

Figure 3:
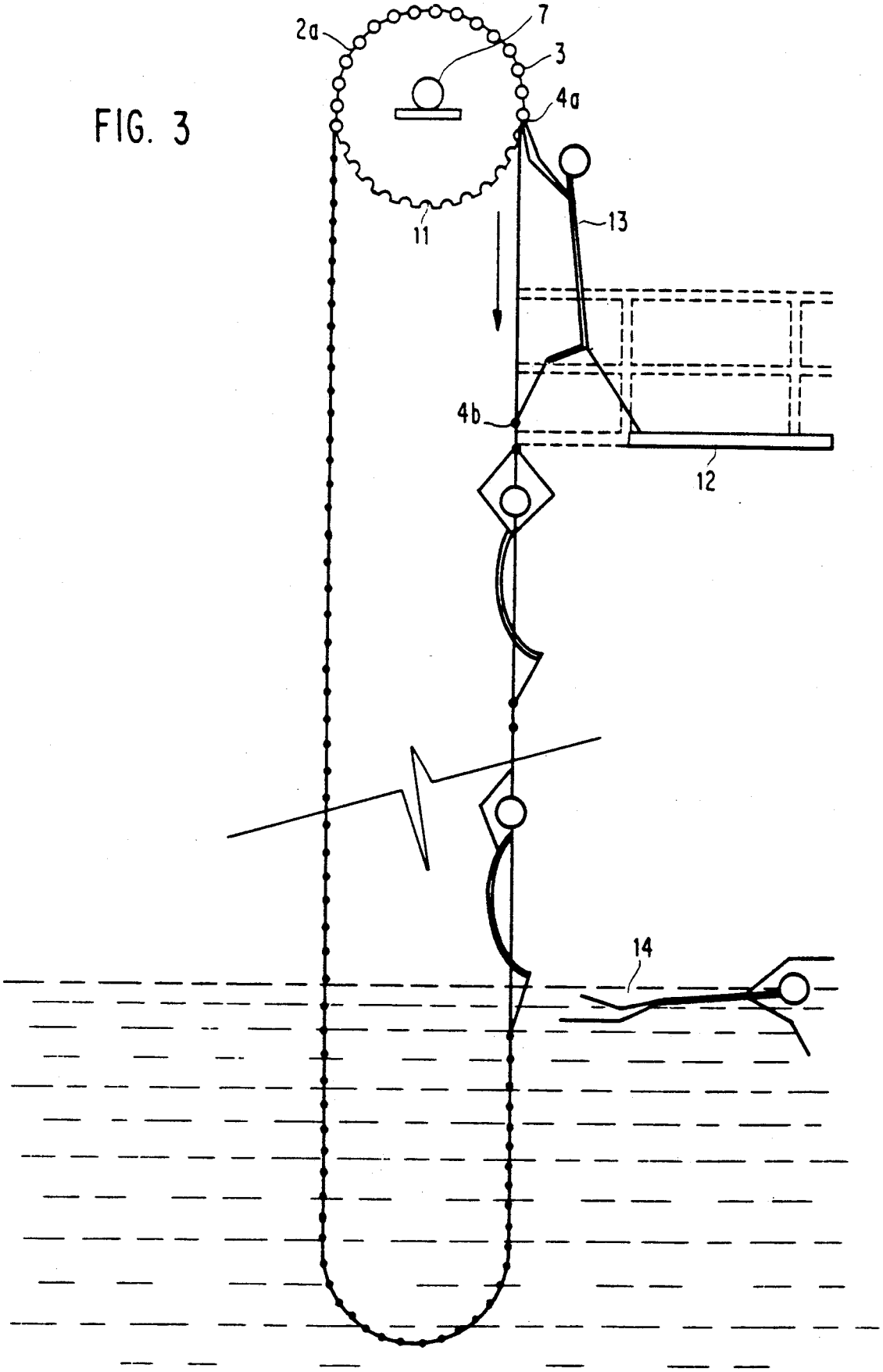
FIG. 3 is a side view showing how to use such moving staircase on offshore platforms.

As can be seen from FIG. 3, the moving staircase (1) may be mounted in any way on to the offshore platform (12), but support (8), upon which cylindrical drum (6) with pulleys (5) in its edge, should jut out from the platform (12), so that the stair might work close to it, while personnel step safely on to the stair (1), onto the pairs of rungs (4*a*, 4*b*). The pairs of rungs lie sufficiently apart to enable a man (13) to stand up on the thereof rung thereof (4*b*) of a lower pairs of rungs while clinging on to the rung (4*a*) of an upper pair of rungs to balance himself. The moves staircase (1) moving freely around under the weight of those standing on the aforesaid rungs (4*a*, 4*b*), thus enabling them to descend by gravity and safely to the sea (14) and there to leave the stair (1), which means that no motors or electrical gear are needed. The length of the staircase (1) is substantially greater than the distance from the platform (12) to the surface of the sea (14), which means that part of the lower end of the stair (1) will be underwater.

It should be pointed out that in order to make it safe to step onto the first two rungs of the stair (1), these rungs fit into guideways at the sides, meant to prevent the rungs (4*a*, 4*b*) from swaying away when stepped upon. The and moving staircase (1) is usually stowed away under the platform (12). Rolls (3) and non-skid rungs (4*a*, 4*b*) must be made of substances that can stand up to the corrosive action of sea water.

I claim:

1. A moving staircase escape-way for an offshore platform, said escape-way enabling said offshore platform to be evacuated; said moving staircase escape-way comprising:

a) a cylindrical drum having shafts protruding therefrom at opposite ends for rotatably mounting said cylindrical drum to said offshore platform;

b) a pair of spaced apart pulleys disposed at opposite ends of said cylindrical drum, each of said pulleys having semicircular slots which are equally spaced apart around the circumference of each of said pulleys;

c) a first pair of endless wire ropes disposed parallel to one another and which pass through a plurality of rolls spaced apart from one another at equal intervals;

d) a second pair of endless wire ropes disposed parallel to one another and to said first pair of wire ropes and which pass through a plurality of rolls spaced apart from one another at equal intervals;

e) wherein selected pairs of rolls of said first pair of wire ropes are joined to corresponding pairs of parallel rolls of said second pair of wire ropes by pairs of non-skid rungs, said pairs of non-skid rungs being spaced at equal intervals along said staircase; and f) wherein said plurality of rolls of said first pair of wire ropes fit into said slots of a corresponding one of said pulleys, and said plurality of rolls of said second pair of wire ropes fit into said slots of the other of said pulleys as said staircase moves so as to lower a user from said offshore platform.

2. The moving staircase escape-way for an offshore platform according to claim 1, wherein a lower end of said staircase is disposed underwater.

3. The moving staircase escape-way for an offshore platform according to claim 1, wherein each of said intervals between said pairs of rungs is about the same as the average height of a man.

4. The moving staircase escape-way for an offshore platform according to claim 1, wherein said staircase turns freely by gravity and is started merely by the weight of said user standing on the rungs thereof.

* * * * *